US009027369B2

(12) United States Patent
Mueller

(10) Patent No.: US 9,027,369 B2
(45) Date of Patent: May 12, 2015

(54) TOWEL WASHING AND DRYING APPLIANCE

(76) Inventor: Stephen M. Mueller, Williamstown, NJ (US)

( * ) Notice: Subject to any disclaimer, the term of this patent is extended or adjusted under 35 U.S.C. 154(b) by 542 days.

(21) Appl. No.: 13/372,994

(22) Filed: Feb. 14, 2012

(65) Prior Publication Data

US 2012/0222453 A1 Sep. 6, 2012

Related U.S. Application Data

(60) Provisional application No. 61/448,375, filed on Mar. 2, 2011.

(51) Int. Cl.

| | |
|---|---|
| ***D06F 18/00*** | (2006.01) |
| ***D06F 35/00*** | (2006.01) |
| ***D06F 39/04*** | (2006.01) |
| ***D06F 45/12*** | (2006.01) |
| ***D06F 58/12*** | (2006.01) |
| ***D06F 58/16*** | (2006.01) |

(52) U.S. Cl.

CPC ..... *D06F 45/12* (2013.01); *D06F 35/00* (2013.01); *D06F 58/12* (2013.01); *D06F 58/16* (2013.01); *D06F 35/001* (2013.01)

(58) Field of Classification Search

CPC ..... D06F 35/00; D06F 45/12; D06F 35/001; D06F 58/16; D06F 58/01

USPC ..... 68/17 R, 3 R, 13 R

See application file for complete search history.

(56) References Cited

U.S. PATENT DOCUMENTS

| | | | | |
|---|---|---|---|---|
| 2,020,170 | A * | 11/1935 | Borroughs | 8/137 |
| 2,295,955 | A * | 9/1942 | La Page | 38/2 |
| 2,655,022 | A | 10/1953 | Wells | |
| 3,083,481 | A * | 4/1963 | Kamen | 38/2 |
| 3,110,974 | A * | 11/1963 | Paullus et al. | 38/2 |
| 3,112,631 | A * | 12/1963 | Gordon | 68/19.1 |
| 3,526,106 | A * | 9/1970 | Kennedy et al. | 68/13 R |
| 6,418,580 | B1 | 7/2002 | Teran et al. | |
| 2008/0302139 | A1 * | 12/2008 | Zorn | 68/12.18 |

* cited by examiner

*Primary Examiner* — Michael Barr
*Assistant Examiner* — Benjamin L Osterhout
(74) *Attorney, Agent, or Firm* — Norman E. Lehrer

(57) ABSTRACT

The high energy usage and high water usage of conventional washing and drying, specifically for towels, is addressed with the present invention. The "towel-station" of the invention is a single-piece sheet-fed appliance to be located at or near the bathroom, shower or pool to efficiently wash, sanitize, dry and warm a towel. Dramatic savings of energy and water result over that of conventional washing and drying. An additional benefit is the availability to the user of a warm towel after bathing without the use of additional energy since warming is performed as part of the drying process.

7 Claims, 3 Drawing Sheets

TOWEL WASHING AND DRYING APPLIANCE

CROSS-REFERENCE TO RELATED APPLICATIONS

This application claims the benefit of prior U.S. Provisional Patent Application Ser. No. 61/448,375, filed Mar. 2, 2011.

BACKGROUND OF THE INVENTION

The present invention is directed toward a towel washing and drying appliance and more particularly, toward such an appliance that washes, sanitizes, dries and warms one towel at a time and which is located at or near the bathroom.

Existing standard washers and dryers for towels use a large amount of energy and water. Energy is used in the hot water heater, the washer motor and pump, the dryer fan, motor and heating element. Also the air exhausted by the dryer is made-up from outdoors causing heating or cooling energy use by the building. A washer using an electric water heater and an electric dryer uses about 5 kilowatt-hours and about $0.50 per cycle. For 10 towels in a cycle this is ½ kWh or 5 cents per towel. A typical front load washer uses about 24 gallons per cycle. For 10 towels in a cycle this is 2.4 gallons of water per towel. Although the stated cost and water use may seem to be small amounts per towel, the frequency of towel usage per person results in large amounts for households and society as a whole. For households without access to in home washers and dryers the use of a compact, efficient and cost effective bathroom appliance to wash towels can save significantly more cost by reducing external laundry charges. For commercial applications (i.e. the hospitality industry) in addition to saving the cost of energy and water use, the appliance would save significant labor cost by removing towels from the laundry workload.

Prior inventions have been proposed to wash and dry towels in a single machine in an apparent effort to save time and money. U.S. Pat. No. 2,655,022 to Wells, for example, is directed toward a system for washing individual towels wherein the towel is first brought through a washing tank and then a rinsing tank before it passes by and electric heater for drying the same. A similar arrangement is shown in prior U.S. Pat. No. 3,110,974 to Paullus et al. which further includes an ultraviolet light for sanitizing the towels.

While both Wells and Paullus et al. present individual towels to a user, the towels are not actually removable from the apparatus. Rather, the towels are secured to a rod or the like that conveys them through the machine. The towel is merely exposed so that the user can dry his or hands or face. In neither system can the towel be removed so that a person can utilize the same to dry his or her entire body after a bath or shower.

There is, therefore, a need for an appliance that washes, sanitizes, dries and warms one towel at a time and allows the user to remove the towel from the apparatus to be used as a bath towel to dry his or her entire body.

SUMMARY OF THE INVENTION

The present invention is designed to overcome the deficiencies of the prior art discussed above. It is an object of the present invention to provide a towel washing and drying appliance and more particularly, toward such an appliance that washes, sanitizes, dries and warms one towel at a time.

It is another object of the present invention to provide a towel washing and drying appliance that washes, sanitizes, dries and warms one towel at a time and makes it available to be used as a bath towel.

In accordance with the illustrative embodiments demonstrating features and advantages of the present invention, there is provided a towel washing and drying appliance that washes, sanitizes, dries and warms one towel at a time in a linear progression. The unit includes a towel transport system then runs through the unit from a feeder to the towel storage receptor. Manual feeding with sensors to determine proper alignment is first, then washing/sanitizing with wash boxes positioned on either side, then extraction with wringers, followed by drying and then storage of the clean warm towels. The towel transport mechanism may change direction so that the towel is initially directed downward through the unit then up through washing and extraction then down again for drying. This allows for a compact appliance design. After two minutes the towel is ejected into an insulated basket or towel receptor where it is stored, fresh, warm and ready for use.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
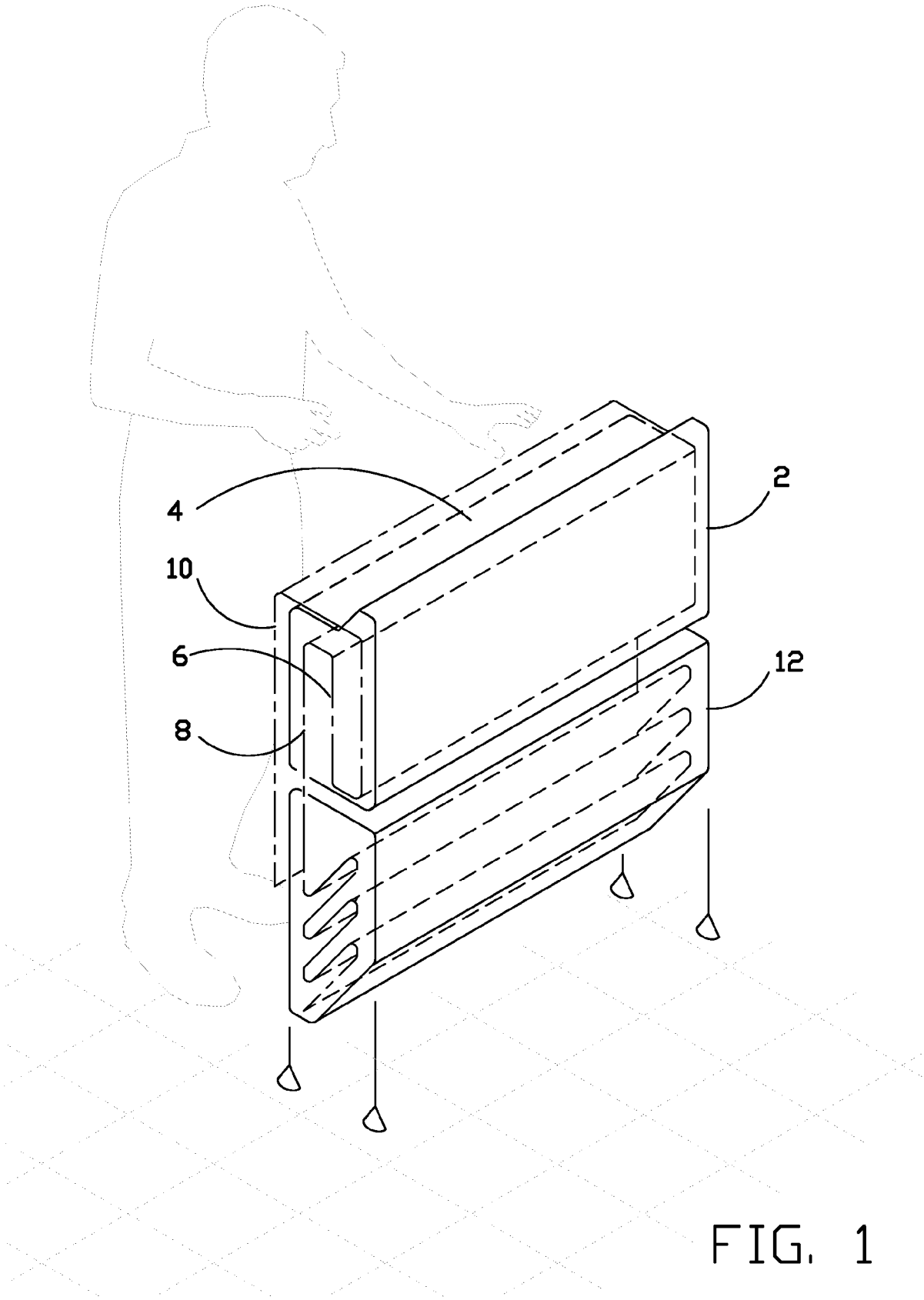
FIG. 1 is a perspective view shown somewhat schematically an illustrating the general arrangement of the invention.
Figure 2:
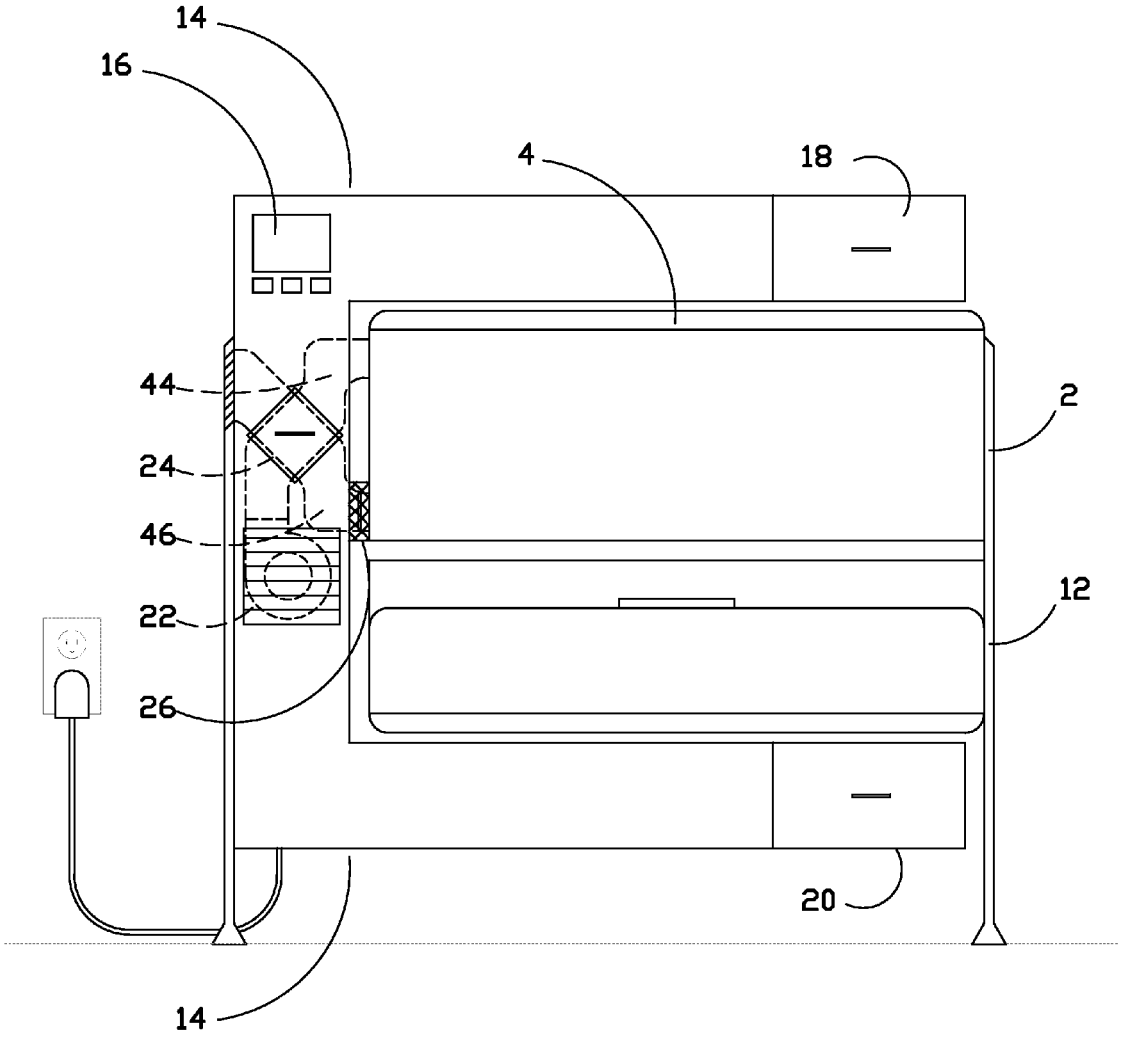
FIG. 2 is a front elevational view of the towel washing and drying invention shown in FIG. 1.
Figure 3:
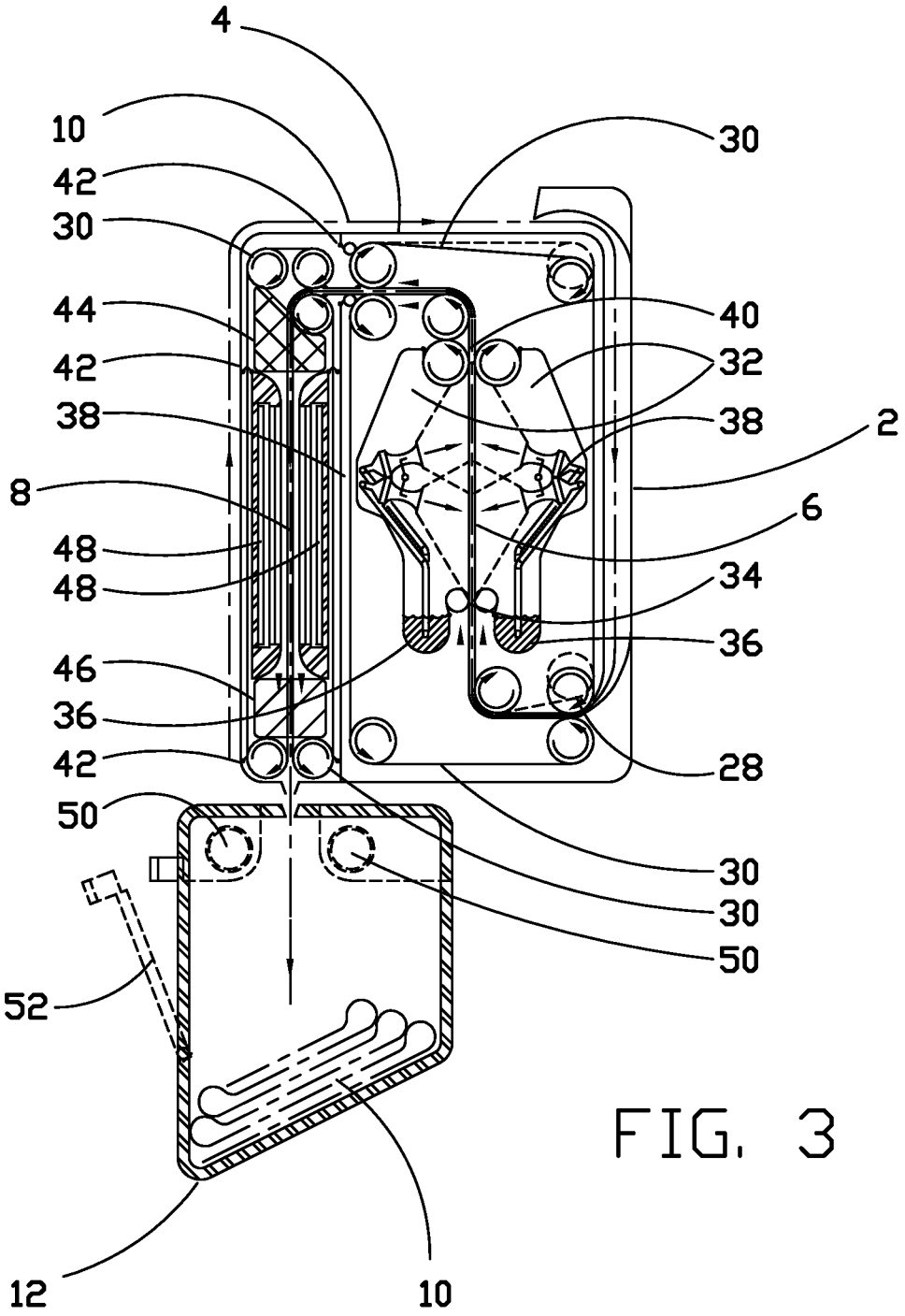
FIG. 3 is a cross-sectional view of FIG. 2 illustrating the operation of the invention.

Referring now to the drawings in detail wherein like reference numerals have been used throughout the various figures to designate like elements, there is shown in FIGS. 1-3 a towel washing and drying appliance constructed in accordance with the principles of the present invention and designated generally as 1.

The towel washing and drying appliance 1 includes a number of component parts. The number shown in the drawings identifying each part along with a brief description of the parts is as follows:

2 laundry processing unit
4 is a manual feed table
6 washer section
8 dryer section
10 towel path
12 insulated towel receptor
14 support unit
16 user interface
18 make-up water tank
20 waste water tank
22 drying fan
24 air-to-air heat exchanger
26 lint filter
28 feed-catch roller
30 support web with rollers

32 wash box
34 water seal rollers or wipers
36 water sump in the wash box
38 wash nozzles
40 wringer and water seal wipers
42 air seal rollers or wipers
44 drying air supply duct
46 drying air return/exhaust duct
48 electric heaters with insulated glass facing and insulation backing
50 optional ultra-violet lights with reflectors and lenses
52 access door to towel storage.

The unit 1 can be floor standing or wall mounted. In either case, it consists essentially of the laundry processing unit 2 and the attached support unit 14. The laundry processing unit 2 includes a number of components including the manual feed table 4 which is where the operator feeds the towel into the unit. A towel transport captures the towel at the feed-catch roller 28 which also contains a support "web" with rollers 30 to support the towel through the machine.

Washing and sanitizing is performed in the wash-box 32 which is a 5 sided box with the open side facing the towel. Preferably, two wash boxes 32 are used, one on each side of the towel. The wash boxes 32 contain a volume of ozone infused cold water at the water sump 36 of the wash box. Compressed air provided the high velocity wash nozzles 38 sends pressurized wash water flow to and through the towel. This wash water flow is cycled in rapid succession and sequenced so that only one side of the towel is pressurized at a time. This dislodges any foreign objects not physically attached to the towel. A water extractor 40 in the form of a wringer consisting of two rollers with resilient surfaces, squeezes the towel tightly to force water from the fibers of the towel and back into the wash box.

Also included is a dryer comprised of electric heaters 48 positioned on each side of the towel and which focus heat directly on the towel to evaporate the remaining water. A stream of room air from the drying air supply duct 44 then carries the evaporated water from the system through the drying air return/exhaust duct 48. Air seal rollers or wipers 42 contain the supply and return/exhaust air and direct the air in the proper direction within the dryer section 8. An air-to-air heat exchanger 24 pre-warms the room air and cools the exhaust air to contain the heat in the system.

The towel receptor 12 is an insulated detachable box that contains one or more towels ready for use. An access door 52 to the towel receptor 12 allows access to the towels while containing the heat of the warmed towel.

The support unit 14 is also comprised of a number of components including a user interface 16 that provides an led readout and function keys for the user to operate the unit 1. In addition, a make-up water tank 18 is located at the top to contain make-up water. Alternately this could be a water line connection. Waste water tank 20 is located at the bottom to contain used waste water. In lieu of a waste water tank, a drain could be connected to the unit.

An air compressor and air tanks can be used to provide the driving force for the wash nozzles 38. An oxygen concentrator in the form of a small oxygen generator provides oxygen to the inlet of the ozone generator which makes ozone ($o_3$) for use as the cleaning agent for the machine. Ozone and clean water are introduced and mixed into a pressure tank providing ozone infused water ready for introduction to the wash boxes 32.

After the towels are washed, the drying fan 22 provides room air to the dryer section 8. A lint filter 26 captures any lint given off from the towel before the drying air is released back into the room and the air to air heat exchanger 24 exchanges heat between air from the dryer section 8 and incoming air. Since condensation may occur in the cooled return/exhaust air, a drain is also provided.

In addition to the above, it is also possible to provide the unit 1 with a detergent tank and dispenser, if desired. Also desirable is the inclusion of ultra-violet lights 50 with reflectors and protective lenses for sterilizing if needed. These two alternate features replace the need for the oxygen concentrator and ozone generator yet maintain the ability to wash with cold water and still provide a sanitized towel. This however may affect the wash cycle as there then needs to be a rinse cycle to eliminate the residual detergent from the towel before extraction and drying.

The necessary elements of the invention are the towel transport mechanism, the wash box 32 with water extraction wringers 40, the drying heater 48 and drying fan 22. Optional features of the invention are ozone washing versus typical detergent wash/rinse with a U-V light 50 for sanitizing.

A basic concept of the invention is linear/full-area laundry processing. As the name implies there is a linear progression of the towel through the laundry processing unit 1. The towel transport system then runs through the unit from the feeder to the towel receptor. Manual feeding with sensors to determine proper alignment is first, then washing/sanitizing with the wash boxes 32 positioned on either side, then extraction with the wringers 40, followed by drying and then storage of the clean warm towel in the towel receptor 12. The towel transport mechanism may change direction so that, for example the towel is initially directed downward through the unit then up through washing and extraction then down again for drying. This allows for a compact appliance design.

The support unit 14 needs to be positioned attached to the laundry processing unit. The user interface 16 needs to be at a convenient and accessible location for the user. Due to the influence of gravity the make-up water tank 18 or connection needs to be at the top and the waste water tank 20 or connection needs to be at the bottom.

The oxygen generator is a device which makes an ozone generator more efficient. The ozone gas is infused into water in a preparation tank to produce a saturated solution of ozone in water. This provides for a very effective cleaning solution that acts on dirt, oil, grease and bacteria. Because ozone is highly reactive it breaks down completely after use into oxygen and water. This provides for effective cold water washing without detergent and eliminates the need for a rinse operation. The ozone system then feeds the wash boxes 32 and would need to be located in proximity to the washing/sanitizing station in the laundry processing unit 2.

The drying fan 22 needs to be located in proximity to the dryer section 8 in the laundry processing unit 2. Air is pulled in through the air-to-air exchanger 24 then through the fan then to the dryer section 8. From the dryer section 8 the air is exhausted first through a small lint filter 26 then through the other side of the air-to-air heat exchanger 24. A drain line is connected to the inlet air side of the exchanger 24 for any condensed water. The support unit 14 also has a cord and plug for connection to an electrical wall outlet.

The user would initially press a "FEED/WASH" or similar button. The user would then manually feed the top edge of the towel into the machine. Alignment sensors will detect if the towel is mis-aligned and then create an alarm for the user to re-align the towel into the unit. When properly fed with a towel the towel transport mechanism with the feed-catch roller 28 will change position to catch the towel and transport it to the first wash position in the washing station 6. At the same time the ozone system starts to generate ozone, water is dumped into the preparation tank and the air compressor starts to fill a pressurized receiver with compressed air. When sufficient ozone is generated it infuses into the water preparation tank. This wash water is then dumped into each wash box 32. The compressed air is released into the wash nozzles 38 in the wash box 32 and the washing starts for the full width of the towel and the height of the wash box 32.

When this first wash location is complete the towel transport engages and positions the towel to the second wash location while at the same time wringing residual water from the towel using the wringer 40. This then progresses for the full height of the towel. At some point after the first two wash locations are completed the leading edge of the towel reaches the dryer section 8 location. This triggers the start of the electric heaters 48. When the heat has reached a certain level the drying fan 22 starts. A moisture sensor detects when drying is sufficient and releases the mechanism to advance once the next wash location has completed. This then repeats for the full height of the towel. If the alternate U-V lights 50 are employed in the design, they are activated when the first section of towel reaches the light station and deactivated when the towel is complete. Safety sensors and devices prevent overheating of the towel in the dryer section 8. When the towel has completely processed an alarm signals the user. The user can then retrieve the washed, sanitized, dried and warmed towel.

An alternate process would be the warming of a clean towel. In this case the user would press a "FEED/WARM" or similar button and all the above processes would engage except for the wash, wash support features and the dryer fan 22. Instead of a moisture indicator triggering the advance of the towel a simple timer or thermal sensor would be used. The same safety features would be used to prevent overheating of the towel.

The operation of the towel washing and drying unit 1 would involve a person feeding a dirty towel into the machine before the start of a bath or shower. The machine washes, sanitizes, dries and therefore warms the towel. After two minutes the towel is ejected into an insulated basket or towel receptor 12 where it is stored, fresh, warm and ready for use.

As should be readily apparent to those skilled in the art, the invention is different from typical washing and drying. The geometry of the bath towel is unique to other pieces in the laundry. A bath towel is a single ply textile with a consistent width of about 27 inches. This allows for a compact sheet-fed laundry machine to wash, sanitize and dry towels in a linear process which exposes the full surface area of each side of the towel to the workings of the machine. This linear/full-area processing is completely different that the normal laundry process and allows for a dramatic reduction in energy and water use. Because bath towels make up a high percentage of total washing loads the result is a significant savings to overall laundry cost. Because warming of the towel is integral to the drying process and because the automated appliance is located in proximity to the bath, shower or pool, no additional energy is needed to provide the user with the luxury of a warm bath towel with every bath or shower.

The present invention may be embodied in other specific forms without departing from the spirit or essential attributes thereof and accordingly, reference should be made to the appended claims rather than to the foregoing specification as indicating the scope of the invention.

I claim:

1. A towel washing and drying appliance comprising:

a housing, said housing including an opening for introducing the leading free edge of a towel into the interior of said housing;

a feed table adjacent the housing for supporting said towel thereon;

gripping means within said housing for temporarily gripping the leading free edge of said towel as it is introduced through said opening;

drive means within said housing for holding said towel and moving it through the interior of said housing;

washing means within said housing for spraying water onto said towel as it is being moved;

electric heating means within said housing for heating said towel after it passes through said washing means;

said drive means being arranged so as to totally release said towel after it has been washed and dried and allowing the towel to fall downwardly, and towel storage means located beneath said housing for storing towels that have been washed and dried and that have been released from said drive means.

2. The towel washing and drying appliance as claimed in claim 1 wherein said housing includes an opening adjacent the bottom thereof and wherein towels that have been washed and dried pass through said opening into said storage means.

3. The towel washing and drying appliance as claimed in claim 1 further including a drying fan within said housing for directing heat from said heaters toward said towel being dried.

4. The towel washing and drying appliance as claimed in claim 1 further including an ozone generator and means for infusing ozone into said water.

5. The towel washing and drying appliance as claimed in claim 1 further including ultra violet lights located adjacent said storage means for sanitizing said towel as it enters said storage means.

6. The towel washing and drying appliance as claimed in claim 1 wherein said towel storage means includes a door for gaining access to towels stored therein.

7. The towel washing and drying appliance as claimed in claim 1 wherein said drive means includes a web that supports said towel as it is transported through said housing.

* * * * *